United States Patent [19]

Dijon et al.

[11] Patent Number: 4,825,202

[45] Date of Patent: Apr. 25, 1989

[54] CONTROL MEANS FOR AN INTEGRATED MEMORY MATRIX DISPLAY AND ITS CONTROL PROCESS

[75] Inventors: Jean Dijon, Grenoble; Thierry LeRoux, Fontaine, both of France

[73] Assignee: Commissariat a l'Energie Atomique, Grenoble, France

[21] Appl. No.: 50,905

[22] PCT Filed: Dec. 15, 1986

[86] PCT No.: PCT/FR86/00309

§ 371 Date: Apr. 30, 1987

§ 102(e) Date: Apr. 30, 1987

[87] PCT Pub. No.: WO87/01849

PCT Pub. Date: Mar. 26, 1987

[30] Foreign Application Priority Data

Sep. 16, 1985 [FR] France ..... 85 13699

[51] Int. Cl.[4] ..... G09G 3/20

[52] U.S. Cl. ..... 340/752; 340/784

[58] Field of Search ..... 340/752, 784, 765, 768, 340/750, 799; 350/330, 331 R

[56] References Cited

U.S. PATENT DOCUMENTS

| | | | |
|---|---|---|---|
| 4,141,000 | 2/1979 | Thomas et al. | 340/752 |
| 4,236,155 | 11/1980 | Nagata | 340/784 |
| 4,365,242 | 12/1982 | Yasuda et al. | 340/752 |
| 4,646,074 | 2/1987 | Hashimoto | 340/784 |
| 4,701,799 | 10/1987 | Yoshimura | 340/784 |
| 4,716,403 | 12/1987 | Morozumi | 340/784 |

FOREIGN PATENT DOCUMENTS 2113444 3/1983 United Kingdom .

*Primary Examiner*—Gerald L. Brigance
*Assistant Examiner*—Mahmoud Fatahiyar
*Attorney, Agent, or Firm*—Oblon, Fisher, Spivak, McClelland & Maier

[57] ABSTRACT

A control system for an integrated memory matrix display and its associated process is disclosed. The control system for the matrix display utilizes a first group of n row conductors and a second group of m column conductors which carry appropriate signals for excitation of an electro-optical display material at image points which form the integrated memory of a display. A first selection circuit is connected to n' address rows and to n row conductors where n is $\leqq 2^{n'}$ and m read-write circuits, each connected to a column conductor and combine into k packages wherein each package has a maximum of l read-write circuits with the integers m, l and k being such that l is >1 and <m and k is >1 and <m. Each pth read-write circuit of package is connected to the pth row of a bidirectional data bus 21 with l rows, with the p being an integer such that $p \geqq 1$ and $\leqq l$. Also contained in this system is k processing circuits which are each connected on the one hand to a package of read-write circuits and on the other two a second selection circuit which itself is connected to k' address rows with k being $\leqq 2^{k'}$.

20 Claims, 3 Drawing Sheets

FIG. 3
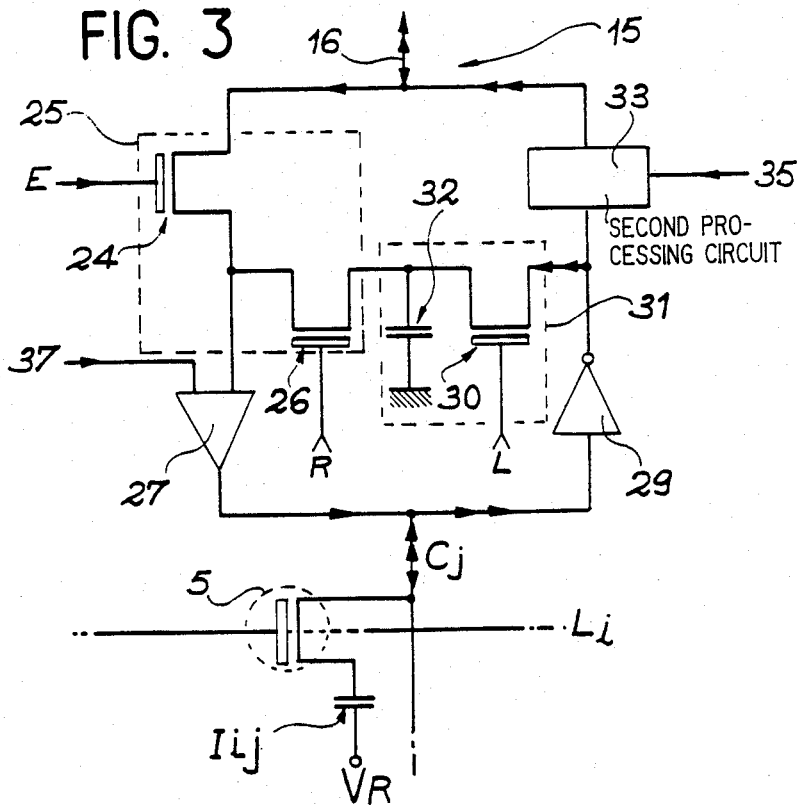
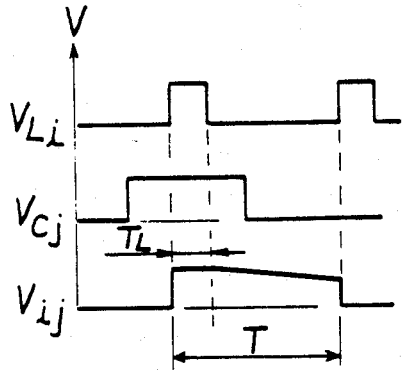
FIG. 4a
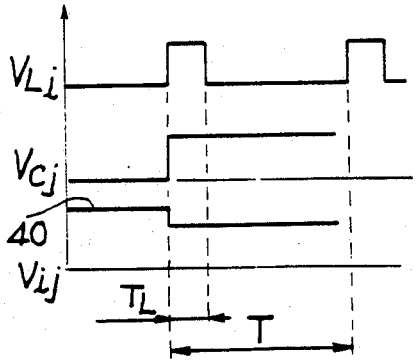
FIG. 4b

CONTROL MEANS FOR AN INTEGRATED MEMORY MATRIX DISPLAY AND ITS CONTROL PROCESS

The present invention relates to a control means for an integrated memory matrix display and to its control process.

The invention more particularly applies to any matrix display with an active matrix having an electrooptical display material, whereof an optical property such as opacity, refractive index, transparency, absorption, etc. can be modified with the aid of a random excitation.

The invention particularly advantageously applies to liquid crystal matrix displays without grey level, e.g. used as converters of electrical informations into optical informations for the real time processing of optical images for analog display purposes.

For reasons of clarity, throughout the remainder of the text the example of the liquid crystal will be used, although any other electrooptical material can be considered.

Figure 1A:
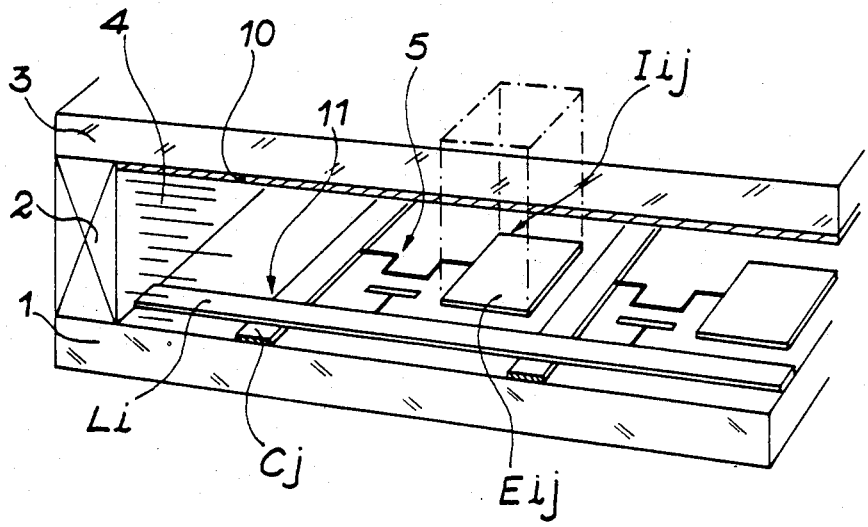
Figure 1B:
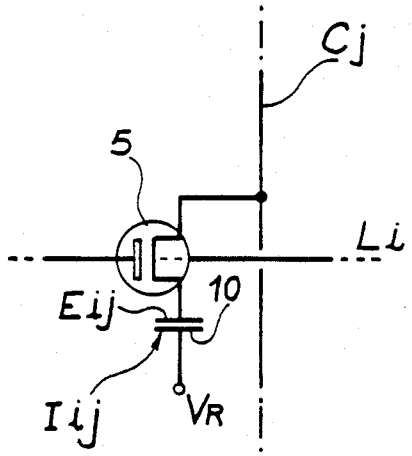

FIG. 1*a* diagrammatically shows a matrix display with an active matrix of a known type and FIG. 1*b* shows the control circuit associated with an elementary image point of said display.

FIG. 1*a* shows first and second insulating walls 1, 3 facing one another and which are kept spaced and sealed by a joint 2 arranged on the periphery thereof. Between said walls 1, 3 is inserted a display material 4 having an optical property.

Over the inner face of one of the walls 1 are distributed n parallel row conductors $L_i$ and m parallel column conductors $C_j$, which intersect with the row conductors, i and j being integers such that $1 \leqq i \leqq n$ and $1 \leqq j \leqq m$, the row conductors and column conductors carrying electrical signals appropriate for the excitation of material 4.

At the intersection 11 of each row conductor $L_i$ with each column conductor $C_j$, there is a switch 5, such as a field effect transistor connected to an electrode $E_{ij}$ and to conductors $L_i$ and $C_j$. Moreover, the inner face of the other wall 3 is covered with a conductive material serving as a counterelectrode 10, which is raised to a reference potential.

An image point $I_{ij}$ is defined in said display by the overlap region of an electrode $E_{ij}$ land the counterelectrode 10, electrode $E_{ij}$ and counterelectrode 10 respectively forming the two armatures or coatings of a capacitor, whose display material, in particular the liquid crystal placed between these armatures forms the dielectric.

In the particular case where the display material is a liquid crystal film, in order to prevent deterioration thereof, the counterelectrode 10 is raised to a reference potential $V_R$, whose value is periodically inverted and the column and row conductors carry electrical signals e.g. in square-wave form.

FIG. 1*b* shows in known manner the electric circuit diagram of a control circuit associated with an image point $I_{ij}$, the latter being represented by a capacitor. Thus, with the intersection of a row conductor $L_i$ and a column conductor $C_j$ is associated a field effect transistor 5 connected to one of the armatures of the capacitor corresponding to electrode $E_{ij}$. The other armature of said capacitor corresponding to the counterelectrode is raised to the reference potential $V_R$. This capacitor makes it possible to store the information to be displayed at image point $I_{ij}$.

When applying an electrical signal to row $L_i$ such that the potential applied to the corresponding transistor 5 is equal to or higher than the threshold voltage of said transistor, the latter is in the on state. It then makes it possible to transmit the electrical signal applied to column $C_j$ to electrode $E_{ij}$ to which it is connected. When the electrical signal applied to row $L_i$ is such that the resulting potential applied to the corresponding transistor 5 is below the threshold voltage of transistor 5, the latter passes into the off state no matter what the signal of column $C_j$ and transmits no signal to electrode $E_{ij}$, which will therefore retain its initial charge. This applies to each elementary image point of the display.

The column electrical signal transmitted to electrode $E_{ij}$ produces an electric field between the armatures of the capacitor constituted by electrode $E_{ij}$ and the counterelectrode. This field causes a collective orientation of the liquid crystal molecules between the capacitor coatings or armatures, when the transmitted signal is above a certain threshold voltage, which corresponds to the minimum value necessary for exciting the liquid crystal. By using collective orientation and punctiform excitation of the liquid crystal molecules, an image is made to appear on the complete display.

Other matrix displays with an active matrix are known. Thus, for example, FR-A No. 2 553 218 describes another type of matrix display with an active matrix. On the inner face of one of the walls of said display are arranged parallel column conductors connected to parallel column electrodes and on the inner face of the other wall of the display are arranged parallel row conductors connected by transistors to electrodes distributed in matrix-like manner, which face the column electrodes, said transistors also being connected to a reference potential $V_R$.

An image point of said display is defined by the overlap zone of an electrode with a column electrode, said two electrodes respectively forming the two coatings or armatures of a capacitor.

The electric diagram of the control circuit associated with an image point of such a display differs from that shown in FIG. 1*b* through the position of the capacitor. Thus, in this case the capacitor is connected between the column conductor and the transistor, the latter also being connected to the corresponding row conductor and to the reference potential $V_R$. The signals applied to the row and column conductors of the matrix displays, like those described hereinbefore, come from a control means.

In known manner, a control means comprises an image memory outside the display connected via interface to control means, such as a computer, an image controller connected to the external image memory by means of logic circuits, series video signal handling circuits connected to the image controller and video signal processing circuits connected to said handling circuits. The computer manages the different components of the control means and transmits the informations to be displayed to the external image memory.

The image controller makes it possible to read by scanning the information stored in the external image memory. The handling circuits transmit to the processing circuits video signals produced from signals supplied by the image controller. These processing circuits make it possible to transcribe the video signals from means such as ships' registers into row signals and column signals. The latter are respectively transmitted to the row conductors and the column conductors, so as to obtain a point-by-point display or the display means.

This control means makes it possible only to write informations into the image points of the display. In order to refresh an information at an image point, rewriting thereof takes place using the corresponding information in the external image memory and not in the actual image point. Refreshing takes place every 20 milliseconds and consequently the frequency of the video signals containing the informations to be displayed in series must be fast at approximately 5 MHz. Consequently the control means must be produced with rapid technology, i.e. of monocrystalline silicon, which suffers from the disadvantage of making its manufacture complex and its manufacturing cost high.

Control means are also known in which the image memory is integrated into the display and which make it possible not only to write, but also read and refresh informations in the image points of the display. Such a means is for example described in GB-A No. 2 113 444.

The invention relates to a novel control means, whereof the image memory is integrated into the display and which in particular makes it possible to obviate the aforementioned disadvantages and which can be produced both with fast and slow technology.

The control means according to the invention is applicable to all matrix displays having an active matrix and in particular to those referred to hereinbefore.

More specifically, the present invention relates to a control means for a matrix display having n·m image points arranged in matrix manner, a first group of n row conductors and a second group of m column conductors carrying appropriate signals for exciting an electro-optical display material, each image point of the display, formed from a capacitor whose dielectric is constituted by the display material, being associated with a row conductor, a column conductor and a switch, each image point forming a memory point of the display in which it is possible to write, read and refresh an information, characterized in that the control means comprises m read - write circuits, each connected to a column conductor for reading, writing and refreshing an information at the image points associated with said column conductor, said read-write circuits being combined into k packages, each of which has at the most l read-write circuits, with m, l and k integers such that $1 \leqq l \leqq m$ and $1 \leqq k \leqq m$, the packages of read-write circuits being connected to a bidirectional data bus of l rows, the pth read-write circuits of a package being connected to the pth row of said bus, with p being an integer such that $1 \leqq p \leqq l$, the reading, writing and refreshing operations performed by the read-write circuits beign selected on the basis of control signals.

In the case where k and l are multiples of m, all the packages preferably have the same number l of read-write circuits ($m = l \cdot k$). In the opposite case, all the packages do not have the same number of read-write circuits and in particular one of the packages has a smaller number of read-write circuits than the other packages.

According to a preferred embodiment, the control means comprises processing means having k processing circuits, each connected to a read-write circuit package, the reading, writing and refreshing operations performed by the read-write circuits being selected by means of processing circuits receiving the control signals and supplying selection signals to the read-write circuits.

Advantageously, the control means comprises a first selection circuit, such as a decoder connected at the input to n' address rows and at the output to n row conductors with $n \leqq 2^{n'}$ for selecting only one row conductor at once.

Preferably the control means comprises a second selection circuit, such as a decoder connected at the input to k' address rows and at the output to k processing circuits with $k \leqq 2^{k'}$ for selecting a single package of column conductors by choosing one processing circuit at once.

According to an embodiment of the means, each row of the bidirectional data bus comprises a single conductor able to carry information in two opposite directions.

According to a constructional variant of the means, each row of the bidirectional data bus comprises first and second conductors able to carry informations respectively in a first and a second direction, said first and second directions being opposite.

The control means according to the invention does not use an external image memory, so that its construction is simplified. Moreover, the display effected at several image points at once makes it possible for production to take place with slow technology, i.e. of amorphous silicon.

According to another embodiment of the control means, the switch is a transistor.

According to an embodiment of the control means, each read-write circuit comprises writing means which, in the information transfer direction, have a first processing circuit and a first amplifier connected to one another, as well as reading means connected in parallel to the writing means, said reading means having in the information transfer direction, a second amplifier connected both to a storage means and to a second processing circuit, the storage means also being connected to the first processing circuit to enable the information which has been read and stored to be refreshed.

The function of the first processing circuit is to transmit either an information from the data bus to the first amplifier, or an information from the storage means to the first amplifier, as a function of the selection signals received by said circuit.

A function of the second processing circuit is to transmit the information which has been read to the data bus. Moreover, said circuit optionally makes it possible to adapt the electrical signal corresponding to the read information to an electrical signal of the binary type compatible with the logic levels of the external electronics located at the output of the data bus. This second processing signal e.g. comprises a window comparator.

According to a preferred embodiment of the control means, the first processing circuit of each read-write circuit comprises a first transistor connected to the first amplifier and used for transferring an information to be written to said first amplifier, as well as a second transistor connected both to the first transistor and to the amplifier and also to the storage means, said second transistor being used for transferring a read information to be refreshed, i.e. rewritten to said first amplifier.

According to another preferred embodiment of the control means, the storage means of each read-write circuit comprises a transistor and a capacitor which are connected to one another, the transistor also being connected to the second processing circuit and to the second amplifier, whilst the capacitor is also connected to the first processing circuit.

According to another preferred embodiment of the contorl means, one of the first and second amplifiers of each read-write circuit is an inverting amplifier for applying an alternative signal to the image points.

The invention also relates to a control means of a matrix display having n.m image points arranged in matrix manner, a first group of n row conductors and a second group of m column conductors carrying appropriate signals for exciting an electrooptical display material, each image point of the display formed by a capacitor, whose dielectric is constituted by the display material beig associated with a row conductor, a column conductor and a switch, each image point constituting a memory point of the display in which it is possible to write, read and refresh an information characterized in that the control means comprises m read-write circuits, each connected to a column conductor for writing, reading and refreshing an information at the image points associated with said column conductor, the read-write circuits being connected to a bidirectional data bus, the reading, writing and refreshing operations performed by said read-write circuits being selected on the basis of control signals, each read-write circuit comprising writing means which, in the information transfer direction, have a first processing circuit and a first amplifier which are connected together, as well as reading means connected in parallel to the writing means, said reading means having in the information transfer direction, a second amplifier connected both to the storage means and to a second processing circuit, the storage means also being connected to the first processing circuit to enable the read and stored information to be refreshed.

The first and second processing circuits of each read-write circuit have the same function as those described hereinbefore and consequently preferably have the same components. This also applies with respect to the other components of the read-write circuit.

According to a preferred embodiment, the control means comprises processing means connected to the read-write circuits, the reading, writing and refreshing operations performed by the read-write circuits being selected via processing means receiving control signals and supplying selection signals to the read-write channels.

According to another preferred embodiment the m read-write circuits are combined into k packages, each package having at the most l read-write circuits, with m, l and k being integers such that $1 \leqq l \leqq m$ and $1 \leqq k \leqq m$, the data bus having l rows, the pth read-write circuit of a package being connectedto the pth row of said bus with p being an integer such that $1 \leqq p \leqq l$. Advantageously the means according to the invention in this case comprises processing means having k processing circuits, each connected to a package of read-write circuits, the reading, writing and refreshing operations performed by said read-write circuits being selected by means of processing circuits receiving the control signals and supplying selection signals to the read-write circuits.

Preferably, said control means comprises a first selection circuit connected at the input to n' address rows and at the output to n row conductors, with $n \leqq 2^{n'}$ for selecting a single row conductor at once.

Moreover, said control means advantageously comprises a second selection circuit connected at the input to address rows and at the output to the processing means for selecting at least one column conductor at once.

When the read-write circuits are combined into packages, said second selection circuit makes it possible to select one package of column conductors at once and in the opposite case, it selects a single column conductor at once.

The invention also relates to a process for controlling a means according to the invention, characterized in that for reading an information at an image point of the display by transmitting it from the image point to the data bus via the read-write circuit corresponding to said image point or for writing an information at said image point by transmitting it in the reverse direction, selection takes place both of the row conductor and the column conductor corresponding to said image point and for reading an information at an image point of the display by transmitting it from the image point to the corresponding read-write circuit or for refreshing an information at said image point by transmitting it in the reverse direction, selection takes place of at least one row conductor corresponding to said image point, said reading, writing and refreshing operations being selected on the basis of control signals.

Other features and advantages of the invention can be best gathered from the following illustrative and non-limitative description and with reference to the attached FIGS. 1*a* to 5, wherein show:

FIGS. 1*a* and 1*b:* Already described, diagrammatically and respectively a known matrix display with an active matrix and the electrical diagram of the control circuit of an image point of said display.

Figure 2:
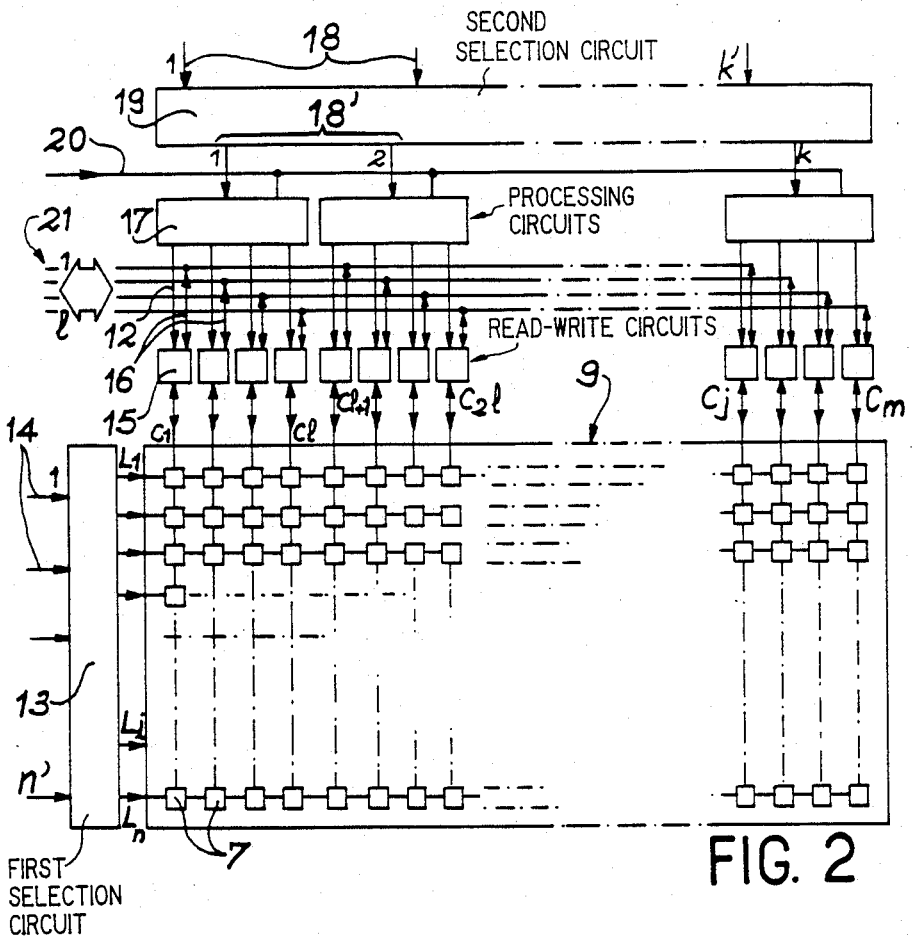

FIG. 2: Synoptically an example of a control means according to the invention for a matrix display.

FIG. 3: An example of a read-write circuit according to the invention for an image point of the display, said circuit being associated with the control circuit of said image point.

FIG. 4*a:* An exemplified timing diagram of signals applied to a row conductor and a column conductor and the resulting signal applied to the corresponding image point during a writing operation according to the invention.

FIG. 4*b:* An exemplified timing diagram of the signals applied to a row conductor, a column conductor and the corresponding image point during the reading operation according to the invention.

Figure 5:
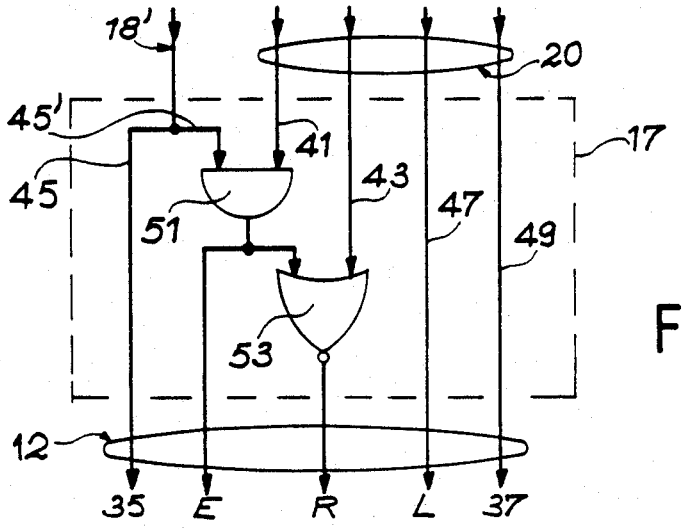

FIG. 5: An example of a processing circuit for the control means according to the invention.

FIG. 2 shows a matrix display 9 having n·m elementary image points. Each image point is associated with a row conductor $L_i$, a column conductor $C_j$, with i and j being integers such that $1 \leqq i \leqq n$ and $1 \leqq j \leqq m$ and to a switch, such as a field effect transistor. This display is e.g. of the same type as described hereinbefore.

In FIG. 2, each group constituted by an image point and the switch associated therewith carries the reference 7. Moreover, for reasons of simplicity, the reference potential $V_R$ is not shown.

The control means shown in FIG. 2 comprises a first selection circuit 13, such as a decoder connected to n' address rows 14 and to n row conductors $L_i$ with $n \leqq 2^{n'}$. The m column conductors $C_j$ are combined e.g. into k packages of in each case l column conductors, each column conductor $C_j$ being connected to a read-write circuit 15. The m column conductors and their corresponding read-write circuits 15 are combined into k packages of l column conductors and l circuits 15 via processing means comprising processing circuits 17, one processing circuit 17 per package of l column conductors and l read-write circuits 15. Thus, there are k processing circuits 17 in said control means.

Each read-write circuit 15 of a package is connected to the processing circuit 17 corresponding to said package by a bus 12. Moreover, each read-write circuit 15 of a package is connected to a row of a l row bidirectional data bus 21, the pth read-write circuit of a package being connected to the pth row of the bus 21, with p being an integer such that $1 \leqq p \leqq l$. Each read-write circuit is connected to the corresponding row of bus 21 by a bidirectional conductor 16 or by two conductors able to carry informations in opposite directions. Throughout the remainder of the text, the particular example of a bidirectional conductor 16 will be taken.

Each row of the bidirectional bus 21 comprises a single conductor able to carry information in two opposite directions, or first and second conductors able to respectively carry informations in first and second directions, which are opposite.

Each processing circuit 17 is also connected to not shown control means, such as a computer by a bus 20 and to a second selection circuit 19, such as a decoder. This second selection circuit 19 is connected at the input to k' address rows 18 and at the output to k processing circuits by conductors 18' with $k \leqq 2^{k'}$.

The first and second selection circuits 13 and 19 are produced in known manner on the basis of logic gates. For example, these circuits are of the same type as described in DE-A No. 3 101 987. However, examples of the processing and read-write circuits 15 will be described in greater detail with reference to FIGS. 3 to 5.

Each image point $I_{ij}$ of the display, represented by a capacitor, has the capacity to store information. All these capacitors form an image memory integrated into the display and in which it is possible to write, read and refresh informations.

Each operation of refreshing information at the image points of the display is preceded by an operation of reading these informations into said image points. These reading and refreshing operations can be performed at the same time on all the image points of a row of points corresponding to a selected row conductor. During these readign and refreshing operations, the informations are carried from the image points to the corresponding read-write circuits and vice versa.

The reading operations at the image points of the display make it possible to transmit informations from the image points to the data bus 21 via corresponding read-write circuits and the writing operations at the image points of the display make it possible to transmit information from the data bus 21 to the image points via corresponding read-write circuits can be performed independently of one another. Moreover, these reading or writing operations can only be simultaneously performed in a limited number of image points corresponding to the image points associated both with a package of selected column conductors and a selected row conductor. It is obvious that the reading operations making it possible to transmit informations from image points to bus 21 can be followed by operations involving the refreshing of these informations at said image points, in view of the fact that these informations are transmitted via read-write circuits.

Thus, when a row conductor $L_i$ and a package of l column conductors $C_j$, $C_{j+1} \ldots C_{j+l}$ are selected, the informations contained in all the image points corresponding to the row conductor $L_i$ can be read, the read informations being transferred to the read-write circuits. The informations read at image points $I_{ij}$, $I_{ij+1} \ldots I_{ij+l}$ associated both with the row conductor and with the selected column conductors can be transferred to bus 21 and informations from said bus can be written in at said image points, or in other words the information from the pth image point can be transmitted to the pth data row of the bus 21 with p being an integer such that $1 \leqq p \leqq l$ and the information to be written, carried by the pth data row of the bus can be transmitted to the pth column conductor of the selected package and displayed in the pth image point. Conversely, the informations read at the other image points associated with the selected row conductor and with the unselected column conductors can be rewritten into said image points.

By periodically selecting each row conductor, it is possible to periodically read and refresh the informations contained at the image points of the display by transmitting the informations from the image points to corresponding read-write circuits and vice versa. Moreover, in the case where the column conductors are selected, it is possible to read or write informations at the image points corresponding both to the row conductors and to the column conductors which have been selected by transmitting the informations from the image points to the data bus or vice versa, via read-write circuits.

The remainder of the description provides a better understanding of the operation of the means.

In order to select a row conductor $L_i$, from control equipmentsuch as a not shown computer, electric signals are supplied to n' address rows 14 at the input of the selection circuit 13. A zero signal corresponds to bit "0" and a non-zero signal to bit "1". Thus, selection circuit 13 will select on the basis of the n' parallel signals of the n address rows 14, a single row conductor $L_i$ from among the n row conductors connected thereto. Thus, selection circuit 13 supplies to the selected row conductor $L_i$ an electrical signal, such that the resulting potential applied to the transistors 5 connected to said conductor are equal to or greater than the threshold voltage of transistors 5 and to the other row conductors an electrical signal such that the resulting potential applied to the transistors connected to said conductors is below said threshold voltage. All the transistors 5 connected to the selected row conductor $L_i$ will therefore be in the on state, whilst the other transistors 5 associated with the other row conductors will be off.

In the same way, for selecting a package of l column conductors $C_j \ldots C_{j+l'}$ from the control equipment is supplied to the input of selection circuit 19, k' parallel signals by means of the k' address rows 18. The selection circuit 19 will now select one processing circuit 17 from among the k processing circuits 17 of the means connected thereto.

Each processing circuit 17 processes reading, writing or refreshing selection signals as a function of the signals supplied by the selection circuit 19 and control signals (read/write/refresh) from the control means and carried by bus 20. These selection signals are then supplied to the l read-write circuits 15 connected thereto by buses 12.

FIG. 3 shows in detail an example of a read-write circuit 15 connected to a control circuit of the same type as described in FIG. 1*b*, it being understood that any other control circuit of a matrix display with an active matrix can also be used.

A read-write circuit 15 comprises a first processing circuit 25 connected to an amplifier 27 in the information transfer direction from a data bus 26 of row conductor 16 to the corresponding column conductor $C_j$ during a writing operation. In the same way, in the information transfer direction from a column conductor $C_j$ to the corresponding conductor 16 during a reading operation, a read-write circuit comprises in parallel an inverting amplifier 29 connected to a second processing circuit 33 and a storager means 31 connected both to the inverting amplifier 29 and to the second processing circuit 33. Storage means 31 is also connected to the first processing circuit 25.

The information to be written, read or rewritten at an image point $I_{ij}$ is constituted by the potential difference applied between the armatures of the capacitor corresponding to said image point.

In the example of the read-write circuit of FIG. 3, the first processing circuit 25 is realized by two transistors 24, 26 connected so as to form a switch. The storage means 31 is realized by a transistor 30 and a capacitor 32. The second processing circuit 33 is e.g. realized by a known window comparator and which is e.g. formed by a negative feedback amplifier or logic gates and divider bridges. It can also be realized by any device making it possible, on the basis of the information read, to determine the state of the corresponding image point, or in other words transform the information read into a binary electrical signal compatible with the external electronics connected to bus 21 (a zero electrical signal corresponding to an undisplayed state and a non-zero electrical signal to a displayed state).

Capacitor 32 is connected on the one hand to transistor 30 and transistor 26 and on the other hand to earth or ground. Moreover, transistor 30 is connected both to the processing circuit 33 and to amplifier 29, whilst transistor 26 is connected both to transistor 24 and to amplifier 27.

The selection signals for a writing or refreshing operation for an information at image oint $I_{ij}$ and the selection signals of a reading operaton at said image point $I_{ij}$ are processed by the processing circuit 17 associated with the read-write circuit 15. These selection signals are constituted by electrical signals applied to circuit 15 at E and 27 for a writing operation and at L and 35 for a reading operation transferring the information from the image point to the bus 21 by the read-write circuit, as well as at R and 37 for a refreshing operation and at L for a reading operation transmitting the information from the image point to the read-write circuit and more specifically to the capacitor 32 of the storage means.

In order to carry out a writing operation at image $I_{ij}$ corresponding to row conductor $L_i$ and to column conductor $C_j$, the row conductor $L_i$ and column conductor $C_j$ are consequently selected. The transistor 5 associated with said image point is then in the one state. Moreover, a non-zero electrical signal at E is supplied to the transistor 24 of processing circuit 25 and a non-zero electrical signal at 37 to amplifier 27, in such a way that transistor 24 and amplifier 27 are in the on state. The information carried in the form of an electrical signal by conductor 16 and coming from the corresponding row of data bus 21 will pass through transistor 24 and is amplified by amplifier 27 before being transmitted to conductor $C_j$. As transistor 5 is in the on state, the signal will be transmitted to the capacitor corresponding to image point $I_{ij}$ by said transistor 5. Thus, between the capacitor armatures is established a potential difference proportional to the transmitted signal, said potential difference producing an electric field, which will excite the molecules of the liquid crystal inserted between said capacitor armatures. The information displayed at point $I_{ij}$ is consequently dependent on the signal transmitted by the row of the bidirectional data bus 21.

In order to read an information at image point $I_{ij}$ and transfer it to the row of corresponding bus 21, the corresponding row conductor and column conductor are selected and a non-zero electrical signal at 35 is transmitted to the processing circuit 33 and a non-zero electrical signal at L to the transistor 30 of storage means 31, so as to bring circuit 33 and transistor 30 into the on state. The information contained by capacitor $I_{ij}$ in the form of an electrical field is transferred to inverting amplifier 29, amplifier 27 being in the high impedance state due to the fact that it has not received an electrical signal at 37. At the output of amplifier 29, the signal from the capacitor is inverted and transmitted on the one hand to storage means 31 and on the other to processing circuit 33. Transistor 30 of the storage means being in the on state, it consequently transmits to capacitor 32 the signal which has been read, in order to temporarily store the information contained by said signal. Furthermore, the processing circuit 33 which is also in the on state will transmit the signal read to the corresponding row of the bidirectional data bus 21 via conductor 16.

In order to read an information at image point $I_{ij}$ corresponding to a row conductor $L_i$ and to a column conductor $C_j$ and transfer it to capacitor 32, it is sufficient to select the corresponding row conductor (whereby the column conductor $C_j$ may or may not be selected) and supply a non-zero electrical signal at L to transistor 30 so as to bring it into the on state. Transistor 30 then transmits the information read to capacitor 32.

The information contained in capacitor 32 in the form of an electrical field makes it possible to refresh the corresponding image point by rewriting said stored information. Thus, for rewriting an information at image point $I_{ij}$, it is merely necessary to select the corresponding row conductor $L_i$ (whereby the column conductor $C_j$ may or may not be selected) and supply a non-zero electrical signal at R in order to bring to the on state the transistor 26 of processing circuit 25 and a non-zero electrical signal at 37 to bring amplifier 27 into the on state. As transistors 24 and 30 are off, the information will pass through transistor 26 and amplifier 27 before being transmitted to the corresponding column conductor $C_j$. The information initially contained in capacitor $I_{ij}$ in the form of an electrical signal will be rewritten with a reverse polarity due to the inversion of the signal performed by the inverting amplifier 29.

Although amplifier 29 is of the inverting type, it would also be possible for it to be of the non-inverting type, whilst making amplifier 27 of the inverting type.

The polarity of the corresponding signal will be reversed for each refreshing of the information. The application of an alternative signal to capacitor $I_{ij}$ consequently makes it possible to increase the life of the display material, such as the liquid crystal placed between the capacitor armatures. Refreshing is e.g. carried out on a period or cycle of approximately 20 ms.

The timing diagrams of FIGS. 4*a* and 4*b* show examples of exciting signals $V_{Li}$, $V_{Cj}$ respectively applied to a row conductor $L_i$ and to a column conductor $C_j$ during a writing operation (FIG. 4*a*) and during a reading operation (FIG. 4*b*) of an information at the corresponding image point and the resulting signals $V_{ij}$ at the image point. The exciting signals shown are impulse square-wave signals, but other signals, such as sinusoidal signals could also be applied.

Signal $V_{Li}$ applied to the row conductor $L_i$ is non-zero for a time $T_L$, called the row time, which is equal to the addressing period T divided by the number of row conductors n of the means. The signal $V_{Li}$ is zero outside said row time $T_L$. Thus, the transistors associated with the row conductor $L_i$ are only in the on state during the non-zero pulse of signal $V_{Li}$, i.e. for a time $T_L$.

Thus, during a writing operation (FIG. 4*a*), with transistor 5 associated with image point $I_{ij}$ corresponding to a row conductor $L_i$ and a column conductor $C_j$ in the on state, it transmits signal $V_{Cj}$ applied to column $C_j$ to the capacitor $I_{ij}$ corresponding to the image point. When signal $V_{Cj}$ is non-zero, it establishes a potential difference equal to the signal $V_{Cj}$-$V_R$ between the capacitor armatures. The resulting signal $V_{ij}$ seen by the liquid crystal consequently has an amplitude equal to $V_{Cj}$-$V_R$. Throughout the addressing time T, the capacitor armatures remain charged, so that during said time T, the image point retains the information written during the row time $T_L$, except for the charge leaks.

A refreshing operation consists of writing the information read. Consequently it takes place as described hereinbefore the signals $V_{Cj}$ and $V_{ij}$ being the same, but of reverse polarity to that of the preceding period or cycle.

During a reading operation (FIG. 4*b*), in the same way as for a writing or refreshing operation, the transistor associated with the image point in which the information has to be read must be in the on state. Therefore the reading operation takes place at the time when the signal $V_{Li}$ applied to the row conductor $L_i$ is non-zero.

An equipartition of the charge $C_{ij}$ (image of signal $V_{ij}$) contained in capacitor $I_{ij}$ into said same capacitor and into a possible parasitic capacitance associated with the column conductor $C_j$ produces a signal $V_{Cj}$, which is then transferred by the column conductor $C_j$ to read-write circuit 15. Following the reading of signal $V_{ij}$ contained in the capacitor, the potential difference between the armatures of said capacitor is not zero. It decreases from a maximum level 40 obtained during a writing operation to a value equal to $V_{Cj}$-$V_R$.

FIG. 5 shows an example of the processing circuit 17 of a control means according to the invention. Circuit 17 has a logic gate 51 such as an AND gate having two inputs and a logic gate 53, such as a NOR gate, which also has two inputs. The two inputs of gate 51 are respectively connected by a conductor 45' to the corresponding conductor 18' of selection circuit 19 and to bus 20 by a conductor 41. The two inputs of gate 53 are respectively connected to the output of gate 51 and to bus 20 via a conductor 43. Moreover, said circuit 17 has a conductor 45 connected to selection circuit 19 via the corresponding conductor 18' and two conductors 47, 49 respectively connected to bus 20.

At the output, conductor 45, gate 51, gate 53, conductor 47 and conductor 49 are respectively connected at 35, E, R, L and 37 of all the read-write circuits associated with said processing circuit.

The signals applied at L and 37 carried by condcutors 47 and 49 are not dependent on the output signal of selection circuit 19. Therefore these signals are identical for all the read-write circuits of the control means and are solely dependent on the control signals.

The control signals carried by conductors 47, 49 undergo no electronic processing in circuit 17 shown in FIG. 5, but obviously this example is not limitative. Thus, it would be possible to use in circuit 17 components of different types for processing said signals.

For the clarity of the description, the electrical signals have been likened to binary signals of high level "1" and low level "0".

The electrical signals supplied on conductors 41,43, 47 and 49 by bus 20 are dependent on the operations to be validated and the signal carried by conductors 45, 45' corresponds to a high level when the processing circuit is selected and a low level in the opposite case.

To validate an operation of readig the data of the image points at the read-write circuits, conductor 47 must carry a signal with a high level "1". To validate an operation of reading the data of the image points at data bus 21 via read-write circuits, conductors 47 and 45 must respectively carry a high level signal. To validate a writing operation of data of data bus 21 at the image points by the read-write circuits, the signals carried by conductors 45' and 41 must both be at high level in order that the output signal of gate 51 is at high level. To validate a refreshing operation, the output signal of gate 51 must be at low level, as must the signal carried by conductor 43, so that the output signal of gate 53 is at high level. Moreover, to validate a writing or refreshing operation, conductor 49 must carry a signal at a high level.

Thus, with said circuit 17, when a writing operation is validated, a refreshing operation cannot be validated. Conversely, when a writing operation is not validated, particularly in the case where the processing circuit is not selected and the signal of conductor 43 is at low level, the refreshing operation can be validated.

The control means according to the invention can easily be integrated into a conventional display with ancillary means.

Moreover, as a result of the integration of the image memory into the display, it makes it possible to achieve considerable economies particularly with respect to an image memory outside the display, a screen controller and circuits for handling or producing video signals used in the prior art control means. It also makes it possible to read information contained in said integrated memory and therefore to refresh the information read. Moreover, the writing operations can be carried out in l image points at once and refreshing in m image points at the same time. The means according to the invention can be produced with slow technology, particularly amorphous silicon.

The above description with respect to the selection of column conductors in packages is not limitative and the control means according to the invention is also applicable to column conductors selected in unitary manner.

Moreover, the examples of the different circuits described hereinbefore of the means according to the invention are in no way limitative. Thus, other modifications can be made to those circuits without passing beyond the scope of the invention. It would have been possible for the bidirectional data bus 21 to be connected to the read-write circuit 15 via processing circuits 17 and the latter would then have transferred informations from bus 21 to the read-write circuits 15 and vice versa. Moreover, the selection circuits 13, 19 described in FIG. 2 are not indispensable to the operation of the means according to the invention, but make it possible to reduce the number of connections.

We claim:

1. Control means for a matrix display (9) having nxm image points arranged in matrix manner, a first group of n row conductors ($L_i$) and a second group of m column conductors ($C_j$) carrying appropriate signals for exciting an electrooptical display material, each image point ($I_{ij}$) of the display, formed from a capacitor whose dielectric is constituted by the display material, being associated with a row conductor ($L_i$), a column conductor ($C_j$) and a switch (5), each image point forming a memory point of the display in which it is possible to write, read and refresh an information, characterized in that the control means comprises m read-write circuits (15), each connected to a column conductor ($C_j$) for reading, writing and refreshing an information at the image points associated with said column conductor ($C_j$), said read-write circuits (15) being combined into k packages, each of which has at the most l read-write circuits, with m, l and k integers such that $1<l<m$ and $l<k<m$, the packages of read-write circuits being connected to a bidirectional data bus (21) of l rows, the pth read-write circuits (15) of each package being connected to the pth row of said bus, with p being an integer such that $1 \leqq p \leqq l$, the reading, writing and refreshing operations performed by the read-write circuits being selected on the basis of control signals (20).

2. Control means according to claim 1, characterized in that it comprises processing means having k processing circuits (17), each connected to a package of read-write circuits (15), the reading, writing and refreshing operations performed by the read-write circuits being selected by means of processing circuits receiving the control signals (20) and supplying selection signals (35, E, R, L, 37) to the read-write circuits.

3. Control means according to claim 1, characterized in that it comprises a first selection circuit (13) connected at the input to n' address rows (14) and at the output to n row conductors ($L_i$) with $n \leqq 2^{n'}$ for selecting a single row conductor at once.

4. Control means according to claim 2, characterized in that it comprises a second selection circuit (19) connected at the input to k' address rows (18) and at the output to k processing circuits (17), with $k \leqq 2^{k'}$ for selecting a single package of column conductors ($C_j$) by choosing a single processing circuit (17) at once.

5. Control means according to claim 1, characterized in that each read-write circuit (15) comprises writing means (25, 27) which, in the information transfer direction, have a first processing circuit (250 and a first amplifier (27) which are interconnected, as well as reading means (29, 31, 33) connected in parallel to the writing means, said reading means having in the information transfer direction a second amplifier (29) connected both to a storage means (31) and to a second processing circuit (33), the storage means also being connected to the first processing circuit (25) to permit the refreshing of the information read and stored, the first processing circuit transmitting an information from the data bus or storage means to the first amplifier and the second processing circuit transmitting an information from the second amplifier to the data bus.

6. Control means according to claim 5, characterized in that the first processing circuit (25) comprises a first transistor (24) connected to the first amplifier (27) and used for transferring an information to be written to said first amplifier and a second transistor (26) connected on the one hand to the first transistor (24) and the first amplifier (27) and on the other hand to the storage means (31), said second transistor (26) transferring a read information to be refreshed to said first amplifier.

7. Control means according to claim 5, characterized in that the storage means (31) comprises a transistor (30) and a capacitor (32) which are interconnected, said transistor also being connected to the second processing circuit (33) and a second amplifier (29), whilst capacitor (32) is also connected to the first processing circuit (25).

8. Control means according to claim 5, characterized in that one of the first and second amplifiers (27, 29) is an inverting amplifier for applying an alternative signal to the image points.

9. A control means of a matrix display (9) having n·m image points arranged in matrix manner, a first group of n row conductors ($L_i$) and a second group of m column conductors ($C_j$) carrying appropriate signals for exciting an electrooptical display material, each image point ($I_{ij}$) of the display formed by a capacitor, whose dielectric is constituted by the display material being associated with a row conductor ($L_i$), a column conductor ($C_j$) and a switch (5), each image point constituting a memory point of the display in which it is possible to write, read and refresh an information characterized in that the control means comprises m read-write circuits (15), each connected to a column conductor ($C_j$) for writing, reading and refreshing an information at the image points associated with said column conductor ($C_j$), the read-write circuits (15) being connected to a bidirectional data bus (21), the reading, writing and refreshing operations performed by said read-write circuits (15) being selected on the basis of control signals (20), each read-write circuit comprising writing means (25, 27) which, in the information transfer direction, have a first processing circuit (25) and a first amplifier (27) which are connected together, as well as reading means (29, 31, 33) connected in parallel to the writing means, said reading means having in the information transfer direction, a second amplifier (29) connected both to the storage means (31) and to a second processing circuit (33), the storage means also being connected to the first processing circuit (25) to enable the read and stored information to be refreshed, the first processing circuit transmitting information from the data bus or storage means to the first amplifier and the second processing circuit transmitting an information from the second amplifier to the data bus.

10. Control means according to claim 9, characterized in that it comprises processing means (17) connected to read-write circuits (15), the reading, writing and refreshing operations performed by the read-write circuits being selected by a processing means receiving control signals and supplying selection signals (35, E, R, L, 37) to the read-write circuits.

11. Control means according to claim 9, characterized in that the m read-write circuits are combined into k packages, each package having at the most l read-write circuits with m, l and k integers such that $1 \leqq l \leqq m$ and $1 \leqq k \leqq m$, the data bus (21) having l rows, the pth read-write circuit of a package being connected to the pth row of said bus with p being an integer such that $1 \leqq p \leqq l$.

12. Control means according to claim 11, characterized in that it comprises processing means having k processing circuits (17), each connected to a package of read-write circuits (15), the reading, writing and refreshing operations performed by the read-write circuits being selected by means of processing circuits receiving the control signals (20) and supplying the selection signals (35, E, R, L, 37) to the read-write circuits.

13. Control means according to claim 9, characterized in that it comprises a first selection circuit (13) connected at the input to n' address rows (14) and at the output to n row conductors ($L_i$), with $n \leqq 2^{n'}$, for selecting a single row conductor at once.

14. Control means according to any one of the claims 10 and 12, characterized in that it comprises a second selection circuit (19) connected at the input to address rows (18) and at the output to processing means (17) for selecting at least one column conductor ($C_j$) at once.

15. Control means according to claim 9, characterized in that the first processing circuit (25) comprises a first transistor (24) connected to the first amplifier (27) and use for transferring an information to be written to said first amplifier, as well as a second transistor (26) connected on the one hand to the first transistor (24) and to the first amplifier (27) and on the other handn to the storage means (31), said second transistor (26) being used for transferring a read information to be refresehd to said first amplifier.

16. Control means according to claim 9, characterized in that the storage means (31) comprises a transistor (30) and a capacitor (32) which are interconnected, the transistor also being connected to the second processing circuit (33) and to the second amplifier (29), whilst capacitor (32) is also connected to the first processing circuit (25).

17. Control means according to claim 9, characterized in that one of the first and second amplifiers (27, 29) is an inverting amplifier for applying an alternative signal to the image points.

18. Control process for the control means according to any one of the claims 1 and 9, characterized in that for reading an information at an image point ($I_{ij}$) of the display by transmitting it from the image point to the data bus (21) via the read-write circuit (15) corresponding to said image point or for writing an information at said image point by transmitting it in the reverse direction, selection takes place both of the row conductor ($L_i$) and the column conductor ($C_j$) corresponding to said image point and for reading an information at an image point of the display by transmitting it from the image point to the corresponding read-write circuit or for refreshing an information at said image point by transmitting it in the reverse direction, selection takes place of at least one row conductor corresponding to said image point, said reading, writing and refresing operations being selected on the basis of control signals.

19. A control means for a matrix display having nxm image points arranged in matrix manner, a first group of n row conductors and a second group of m column conductors carrying appropriate signals for exciting an electro-optical display material, each image point of the display, forming from a capacitor whose dielectric is constituted by the display material, being associated with a row conductor, a column conductor and a switch, each point forming a memory point of the display in which it is possible to write, read and refresh an information, wherein said control means comprises m read-write circuits each connected to a column conductor for reading, writing and refreshing an information at the image points associated with said column conductor, said read-write circuits being combined into k packages, each of which has at the most l read-write circuits, with m, l and k integers such that $1<l<m$ and $1<k<m$, the packages of read-write circuits being connected to a bidirectional data bus of l rows, the pth read-write circuits of each package being connected to the pth row of said bus, with p being an integer such that $1 \leqq p \leqq l$, the reading, writing and refreshing operations performed by the read-write circuits being selected on the basis of control signals, said control means further comprising processing means having k processing circuits, each connected to a package of read-write circuits, the reading, writing and refreshing operations formed by the read-write circuits being selected by means of said processing circuits receiving said control signals and supplying selection signals to the read-write circuits, a first selection circuit connected at the input to n' address rows and at the output to n row conductors with n23 $2^{n'}$ for selecting a single row conductor at one time, a second selection circuit connected at the input to k' address rows and the output to k processing circuits, with $k \leqq 2^{k'}$ for selecting a single package of column conductors by choosing a single processing circuit at one time.

20. A control means of a matrix display having nxm image points arranged in matrix manner, a first group of n row conductors and a second group of m column conductors carrying appropriate signals for exciting an electro-optical display material, each image point of the display formed by a capacitor, whose dielectric is constituted by the display material being associated with a row conductor, a column conductor and a switch and each image point constituting a memory point of the display in which it is possible to write, read and refresh an information wherein said control means comprises m read-write circuits, each connected to a column conductor for writing, reading and refreshing an information at the image points associated with said column conductor, the read-write circuits being connected to a bidirectional data bus, the reading, writing and refreshing operations performed by said read-write circuits being selected on the basis of control signals, each read-write circuit comprising writing means which, in the information transfer direction, have a first processing circuit and a first amplifier which are connected together, as well as reading means connected in parallel to the writing means, said reading means having in the information transfer direction, a second amplifier connected both to the storage means and to a second processing circuit, the storage means being also connected to the first processing circuit to enable the read and store information to be refreshed, the first processing circuit transmitting an information from the data bus or storage means to the first amplifier and the second processing circuit transmitting an information from the second amplifier to the data bus, said control means further comprising processing means connected to read-write circuits, the reading, writing and refreshing operations performed by the read-write circuits being selected by said processing means receiving control signals and supplying selection signals to the read-write circuits, said control means further comprising a first selection circuit connected at the input to n' address rows and at the output to n row conductors, with $n \leqq 2^{n'}$, for selecting a single row conductor at one time, and a second selection circuit connected at the input to address rows and at the output to said processing means for selecting at least one column conductor at one time.

* * * * *

UNITED STATES PATENT AND TRADEMARK OFFICE

CERTIFICATE OF CORRECTION

PATENT NO. : 4,825,202

DATED : April 25, 1989

INVENTOR(S) : JEAN DIJON, et al

It is certified that error appears in the above-identified patent and that said Letters Patent is hereby corrected as shown below:

On the title page, item [22]. PCT filing date is incorrect, it should read as follows:

--September 15, 1986--

Signed and Sealed this

Twenty-eighth Day of November 1989

*Attest:*

JEFFREY M. SAMUELS

*Attesting Officer* *Acting Commissioner of Patents and Trademarks*